US010177463B2

(12) United States Patent
Niu

(10) Patent No.: US 10,177,463 B2
(45) Date of Patent: Jan. 8, 2019

(54) ANTENNA SYSTEM AND ELECTRONIC APPARATUS

(71) Applicant: Lenovo (Beijing) Co., Ltd., Beijing (CN)

(72) Inventor: Jiaxiao Niu, Beijing (CN)

(73) Assignee: LENOVO (BEIJING) CO., LTD., Haidian District, Beijing (CN)

( * ) Notice: Subject to any disclaimer, the term of this patent is extended or adjusted under 35 U.S.C. 154(b) by 0 days.

(21) Appl. No.: 14/673,008

(22) Filed: Mar. 30, 2015

(65) Prior Publication Data

US 2016/0190709 A1 Jun. 30, 2016

(30) Foreign Application Priority Data

Dec. 31, 2014 (CN) ..... 2014 1 0855064

(51) Int. Cl.
*H01Q 21/28* (2006.01)
*H01Q 1/24* (2006.01)

(52) U.S. Cl.
CPC ..... *H01Q 21/28* (2013.01); *H01Q 1/243* (2013.01)

(58) Field of Classification Search
CPC ..... H01Q 21/28; H01Q 21/06; H01Q 21/061; H01Q 21/062; H01Q 21/064; H01Q 21/065; H01Q 21/08
USPC ..... 343/725, 893
See application file for complete search history.

(56) References Cited

U.S. PATENT DOCUMENTS 7,782,261 B2 * 8/2010 An ..... H01Q 9/0442 343/702
2008/0122698 A1 * 5/2008 Ollikainen ..... H01Q 1/243 343/700 MS
2010/0156726 A1 6/2010 Montgomery
2011/0136458 A1 * 6/2011 Seo ..... H01Q 1/243 455/269
2011/0148736 A1 6/2011 Choi et al.
2013/0002503 A1 * 1/2013 Tan ..... H01Q 1/243 343/803
2013/0057448 A1 * 3/2013 Satou ..... H01Q 1/36 343/853
2013/0120219 A1 * 5/2013 Tikka ..... H01Q 1/243 343/893

(Continued)

FOREIGN PATENT DOCUMENTS

CN 101512835 A 8/2009
CN 101553953 A 10/2009
CN 102969568 A 3/2013

(Continued)

OTHER PUBLICATIONS

First Office Action dated Dec. 9, 2015 out of corresponding German application No. 102015104980.5 (6 pages).

(Continued)

*Primary Examiner* — Daniel J Munoz

(74) *Attorney, Agent, or Firm* — Brinks Gilson & Lione; John C. Freeman

(57) ABSTRACT

The present disclosure discloses an antenna system that includes a first antenna for transmitting and receiving data and having an electrical length that is equal to its resonant electrical length; a second antenna for receiving data and having an electrical length that is less than its resonant electrical length. The present disclosure also discloses a corresponding electronic apparatus.

5 Claims, 5 Drawing Sheets

(56) References Cited

U.S. PATENT DOCUMENTS

2013/0241800 A1* 9/2013 Schlub ..... H01Q 1/243
343/893

FOREIGN PATENT DOCUMENTS

| | | | |
|---|---|---|---|
| CN | 104022354 | A | 9/2014 |
| CN | 104205485 | A | 12/2014 |
| DE | 10 2013 107 965 | | 2/2015 |
| EP | 2 858 172 | | 4/2015 |
| JP | 2008017098 | A | 1/2008 |

OTHER PUBLICATIONS

Office Action, and English language translation thereof, in corresponding Chinese Application No. 201410855064.X, dated Jan. 31, 2018, 12 pages.

Second Office Action dated Sep. 5, 2018 (11 pages including English translation) from Chinese priority Application No. 201410855064.X.

* cited by examiner

ANTENNA SYSTEM AND ELECTRONIC APPARATUS

This application claims priority to Chinese patent application No. 201410855064.X filed on Dec. 31, 2014, the entire contents of which are incorporated herein by reference.

The present disclosure relates to a field of communication technology, and more particularly, relates to an antenna system and an electronic apparatus.

BACKGROUND

As a new generation of wireless communication system, a Long Term Evolution (LTE) system is increasingly gaining popularity in more and more countries and states. As compared with second generation mobile communication (2G) and third generation mobile communication (3G) systems, the LTE system can provide a higher data transmission rate, and a Multiple-Input Multiple-Output (MIMO) technology is deemed as a core technology of the LTE system and also attracts more and more attention of designers.

The MIMO technology is a space diversity technology by a multi-transmit and multi-receive antennas, which uses a discrete multi-antenna mode, so it can effectively decompose a communication link into a plurality of parallel sub-channels, so as to significantly improve channel capacity, and further improve the data transmission rate of the system. The MIMO technology typically requires multiple antennas to support multiple input and multiple output. In consideration of actual situations and space limitations of a mobile terminal, a mobile terminal is generally provided with two antennas to constitute a MIMO antenna system. One antenna supports input and output at the same time, which is referred as a main diversity antenna. The other antenna generally supports input only, which is referred as a diversity antenna. In order to ensure good performance of the MIMO system, the two antennas not only needs to have a higher efficiency, but also needs to have a lower correlation between the two antennas.

Since there is limited space for accommodating the antennas in the mobile terminal, for example in a low frequency band of 700-960 MHz, a distance between the two antennas is small with respect to a wavelength, a near-field coupling between the two antennas is strong, and respective efficiencies thereof are relatively low. Thus, the MIMO antenna system of a mobile terminal exhibits a poor performance in the low frequency band.

SUMMARY

According to first aspect, an embodiment of the present disclosure provides an antenna system. The antenna system comprises a first antenna and a second antenna. The first antenna is used for transmitting and receiving data. The first antenna has an electrical length that is equal to its resonant electrical length. The second antenna is used for receiving data. The second antenna has an electrical length that is less than its resonant electrical length.

According to second aspect, an embodiment of the present disclosure further provides an electronic apparatus. The electronic apparatus comprises the antenna system as described above.

BRIEF DESCRIPTION OF THE DRAWINGS

In order to clearly illustrate the technical solution of the embodiments of the present disclosure and the prior art, a brief introduction of the drawings of the embodiments shall be given hereinafter. Apparently, the drawings described as follows only relate to some embodiments of the present disclosure and the prior art; for those ordinarily skilled in the art, other drawings can further be obtained based on these drawings without inventive effort.

DETAILED DESCRIPTION

Figure 1:
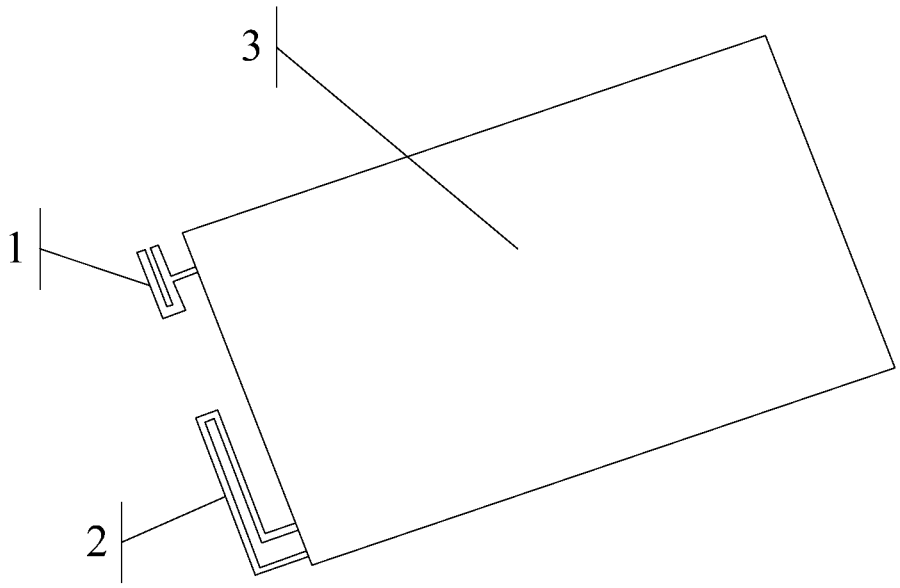
FIG. 1 is a main structural schematic diagram of an antenna system according to an embodiment of the present disclosure.

An embodiment of the present disclosure discloses an antenna system. The antenna system is disposed in an electronic apparatus. The electronic apparatus has a short side and a long side. The short side has a length less than a length of the long side. The antenna system comprises: a first antenna, disposed on the short side, for transmitting and receiving data; a second antenna, disposed on the short side, for receiving data. The first antenna is an antenna whose electrical length is equal to an electrical length required when the first antenna resonates. The second antenna is an antenna whose electrical length is less than an electrical length required when the second antenna resonates.

In the embodiment of the present disclosure, a first antenna and a second antenna constitute the antenna system, the first antenna transmits and receives data, and an electrical length of the first antenna is equal to a resonant electrical length of the first antenna, so it can cover a wider bandwidth, to meet requirements of efficiency and bandwidth of the communication system. The second antenna is only responsible for receiving data, which covers a narrower bandwidth. An electrical length of the second antenna is less than a resonant electrical length of the second antenna, so the second antenna has a smaller size and takes a smaller space. On the premise of satisfying data reception, the second antenna can be kept away from the first antenna as far as possible, to minimize a near-field coupling strength between the first antenna and the second antenna, reduce mutual interference between the two antennas, and maximize respective operation efficiencies of the first antenna and the second antenna, so as to improve overall performance of the antenna system.

Since the second antenna takes a smaller space, more space within the electronic apparatus can be left for the first antenna, so that the first antenna can cover a broader band to obtain a better data transmission efficiency, and to further improve the performance of the antenna system.

In addition, the first antenna and the second antenna are both disposed on the short side of the electronic apparatus. Therefore, the first antenna and the second antenna are able to effectively excite ground-plate mode radiation, which can maximize the data transmission efficiencies of the first antenna and the second antenna. Meanwhile, a distribution direction of the current generated from the ground-plate mode radiation excited by the first antenna resonance and a distribution direction of the current generated from the ground-plate mode radiation excited by the second antenna resonance present a cross distribution, so that the correlation between the first antenna and the second antenna can be minimized. The overall performance of the antenna system can be further improved, and the requirements of the communication system can be met maximally.

Meanwhile, since the first antenna and the second antenna are both disposed on the short side, more space can be left as much as possible for the long side of the electronic apparatus to accommodate a display screen, so as to meet aesthetic requirements on the electronic apparatus, and process design requirements of an ever larger display screen and an ever narrower frame. Moreover, the antenna system can also be kept away from a battery of the electronic apparatus as far as possible, to minimize impact of the battery on the first antenna and the second antenna during energy radiation, so as to improve operation efficiencies and bandwidths of the first antenna and the second antenna.

The technical solutions of the embodiments of the present disclosure will be described hereinafter in a clearly and fully understandable way in connection with the drawings of the embodiments of the disclosure. It is obvious that the described embodiments are just a part but not all of the embodiments of the disclosure. Based on the described embodiments herein, those skilled in the art can obtain other embodiment(s), without any inventive work, which should be within the scope of the disclosure. In case of no conflict, various technical features in the embodiments of the present disclosure may be arbitrarily combined for use. Moreover, although the flowchart shows a logical order, yet in some cases, the steps shown or described can be executed in a different order.

In addition, a term "and/or" herein only describes a correlation between associated objects, which denotes that there are three types of relationships, for example, A and/or B may denote three cases where A exists solely, A and B coexist, and B exists solely. In addition, the character"/" herein generally denotes an "or" relationship between contextual objects, in a case where no specific explanation is given.

The electronic apparatus according to the embodiment of the present disclosure has a short side and a long side, and a length of the short side is less than a length of the long side. When the electronic apparatus has a plurality of short sides and a plurality of long sides, a length of each short side is less than a length of each long side. Typically, the electronic apparatus according to the embodiment of the present disclosure may have two short sides and two long sides. The two short sides are parallel to each other, the two long sides are parallel to each other, and the two short sides and the two long sides are perpendicular to each other. That is, a frame of the electronic apparatus can be considered as consisting of two short sides and two long sides, and an overall appearance of the electronic apparatus can be approximated as a rectangle.

The electronic apparatus according to the embodiment of the present disclosure may be, for example, a mobile phone, a panel computer and other portable mobile terminals. With the electronic apparatus being a mobile phone as an example, an upper side and a lower side of the mobile phone can be viewed as the above-described two short sides, and a left side and a right side of the mobile phone can be viewed as the above-described two long sides. Positions such as up, down, left, right, etc. in the embodiment of the present disclosure are positions specified by taking a positive direction displayed by a display unit of the electronic apparatus a the positive direction.

To better understand the above-described technical solutions, hereinafter, the above-described technical solutions will be illustrated in detail in conjunction with the accompanying drawings and the specific embodiments of the specification.

With reference to FIG. 1, the embodiment of the present disclosure provides an antenna system which is disposed in an electronic apparatus 3. The electronic apparatus 3 has a short side and a long side. The short side has a length less than a length of the long side. The antenna system comprises a first antenna 1 and a second antenna 2.

The first antenna 1 is disposed on the short side, transmits and receives data. The first antenna 1 is an antenna whose electrical length is equal to an electrical length required when the first antenna 1 resonates.

The second antenna 2 is disposed on the short side, and receives data. The second antenna 2 is an antenna whose electrical length is less than an electrical length required when the second antenna 2 resonates.

That is, the first antenna 1 and the second antenna 2 constitute the antenna system. In the embodiment of the present disclosure, the antenna system can be viewed as a MIMO antenna system, the first antenna 1 can be viewed as a main antenna in the MIMO antenna system, and the second antenna 2 can be viewed as a diversity antenna in the MIMO antenna system.

In a specific implementation process, the first antenna 1 and the second antenna 2 may be in a specific form of any one of an FIPA antenna, a monopole antenna, an inverted F antenna (IFA), or a Loop antenna, or may be other form of antenna. The forms of the first antenna 1 and the second antenna 2 will not be limited by the present disclosure, as long as an actual electrical length of the first antenna 1 is equal to its resonant length, and an actual electrical length of the second antenna 2 is less than its resonant electrical length.

In general, an antenna can be equivalent to an LC oscillating circuit. When the antenna resonates at a specific frequency, the LC oscillating circuit forms an LC resonant circuit. At this time, an imaginary part of impedance of the LC resonant circuit is zero, i.e., L (an inductance characteristic) and C (a capacitance characteristic) counterbalance each other, and the LC resonant circuit presents a pure resistance characteristic. The characteristic that the impedance of the LC resonant circuit has a maximum value or a minimum value is called a resonance characteristic, and the specific frequency is the resonant frequency when the antenna resonates.

Moreover, when the antenna resonates at a specific frequency (e.g., 800 MHz), the actual electrical length of the antenna can be viewed as the resonant electrical length of the antenna. That is to say, only when the actual electrical length of the antenna is equal to the resonant electrical length, the antenna will resonate at 800 MHz by itself. In general, the resonant electrical length of the antenna may be ¼, ½, or 1 time of a wavelength of an electromagnetic wave transmitted in the antenna, which is specifically decided by factors such as a resonant number of the antenna, a type of a communication network and a communication mode etc. However, in general, the resonant electrical length of the antenna differs slightly from the wavelength of the electromagnetic wave.

In addition, the present disclosure is mainly about how to improve the performance of the antenna system in the low frequency band (e.g., 700-960 MHz) of LTE for the reasons below: since the electromagnetic wave transmitted in the antenna has a wavelength $\lambda=C/f$, where C is a speed of light which is a value of about $3*10^8$ m/s, and f is a frequency of the electromagnetic wave. If the frequency is 700 MHz, it can be calculated that λ428 mm. It is generally required that a spacing between the two antennas in the MIMO antenna system is at least a half-wavelength, i.e., 214 mm, in order to achieve a good isolation. A maximum spacing between the two antennas is generally about 150 mm as a result of process design and other factors of the electronic apparatus (e.g., a mobile phone). The isolation in the low frequency band is far from enough, which will cause relatively great interference between the two antennas, and it is more difficult to achieve relatively low correlation between the two antennas.

In the embodiment of the present disclosure, the first antenna 1 is responsible for data reception and transmission at the same time, while the second antenna 2 is only responsible for data reception, and the first antenna 1 and the second antenna 2 receive data at the same frequency band. For example, if the antenna system operates in LTE frequency band 8, the operating frequency band of the entire antenna system is just 880-960 MHz. At this time, the first antenna 1 needs to cover a transmission frequency band of 880-915 MHz and a reception frequency band of 925-960 MHz, and the second antenna 2 only needs to cover a reception frequency band of 925-960 MHz.

Since the first antenna 1 is responsible for data reception and transmission at the same time, a relatively wide bandwidth is covered and a relatively high efficiency is required, the actual electrical length of the first antenna 1 is set to be equal to its resonant electrical length. The second antenna 2 is only responsible for data reception, a relatively narrow bandwidth is covered, the actual electrical length of the second antenna 2 is set to be less than its resonant electrical length. In order to save accommodating space within the electronic apparatus 3 as much as possible, the actual electrical length of the second antenna 2 may be set to be far less than the resonant electrical length. On the premise that the second antenna 2 satisfies data reception, since the actual electrical length thereof is far less than the resonant electrical length, that is, far less than the actual electrical length of the first antenna 1, the space taken by the second antenna 2 is far less than the space taken by the first antenna 1. That is, a volume of the second antenna 2 is less than a volume of the first antenna 1. Then, within the limited space of the electronic apparatus 3, the first antenna 1 and the second antenna 2 can be spaced as far as possible. When the first antenna 1 transmits signals to a base station, signal leakage to the second antenna 2 can be avoided. Meanwhile, when the second antenna 2 receives the signals from the base station, receiving leakage signals generated when the first antenna 1 transmits the signals can also be avoided as far as possible. Therefore, the near-field coupling strength and the interference between the first antenna 1 and the second antenna 2 can be minimized as much as possible, respective operation efficiencies of the first antenna 1 and the second antenna 2 can be improved, and further the overall performance of the antenna system can be improved. Moreover, since the second antenna 2 takes a smaller space, more space within the electronic apparatus 3 can be left to the first antenna 1 for use, so that the first antenna 1 can cover a broader frequency band so as to obtain a better data transmission efficiency.

In the embodiment of the present disclosure, the electronic apparatus 3 may be specifically a mobile phone. When the mobile phone is placed horizontally with its front side (a display screen of the mobile phone) facing upward, the short sides can be considered as the upper side and the lower side of the mobile phone, the long sides can be considered as the left side and the right side of the mobile phone, and both the first antenna 1 and the second antenna 2 are disposed on the short sides at the same time. In addition, in the specific implementation process, there are a variety of forms of the specific positions in which the first antenna 1 and the second antenna 2 are disposed on the short sides. In FIG. 1, as an example, the first antenna 1 and the second antenna 2 are disposed on the same short side of the short sides at the same time, i.e., that they are disposed on the lower side of the mobile phone is taken as an example. Of course, there may be other modes for disposing the first antenna 1 and the second antenna 2. For example, another possible mode is to place the first antenna 1 on the lower side of the mobile phone, and place the second antenna 2 on the upper side of the mobile phone.

Figure 2:
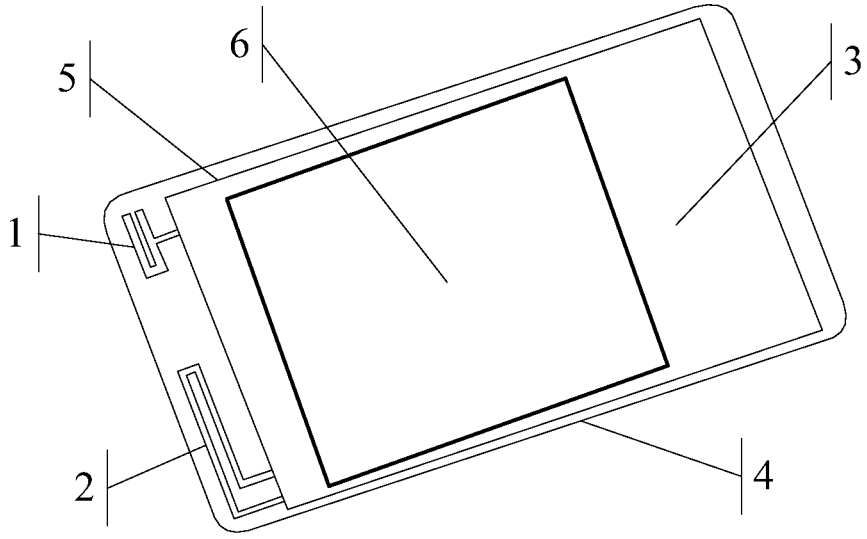
FIG. 2 is structural schematic diagram of an electronic apparatus comprising a ground module and a housing according to an embodiment of the present disclosure.

In the specific implementation process, in order to meet the requirements on aesthetic appearance of the electronic apparatus 3, and in order to minimize damage to the antenna, the first antenna 1 and the second antenna 2 are generally disposed inside the electronic apparatus 3. With reference to FIG. 2, the first antenna 1 and the second antenna 2 are disposed on the short sides, which can be understood as follows: the first antenna 1 and the second antenna 2 are disposed inside a housing 4 of the electronic apparatus 3, and are fixedly disposed in proximity to an outer frame of the electronic apparatus 3. The outer frame may be considered as a frame constituted by four outer sides of the electronic apparatus 3.

Specifically, in the embodiment of the present disclosure, the electronic apparatus 3 may further have a ground module 5. When the first antenna 1 resonates, the first antenna 1 is used for exciting the ground module 5 to resonate to generate a current, which is referred to as a first current in the embodiment of the present disclosure. When the second antenna 2 resonates, the second antenna 2 is used for exciting the ground module 5 to resonate to generate a current, which is referred to as a second current in the embodiment of the present disclosure. A distribution direction of the first current and a distribution direction of the second current present a cross distribution.

In the specific implementation process, the first antenna 1 and the second antenna 2 may be fixedly disposed on a side of the ground module 5 within the electronic apparatus 3. With the electronic apparatus 3 being a mobile phone as an example, the ground module 5 is just a "ground-plate" as commonly known in the mobile phone, and the ground module 5 is generally made of metal, which is a zero potential reference in the mobile phone. The display screen of the mobile phone is in contact with the ground module 5 though a conductive material, a ground of a circuit board in the mobile phone is also in contact with the ground module 5 though a conductive material, and a battery 6 of the mobile phone is placed on the ground module 5. Usually, due to process design and electrical requirements, the ground module 5 is generally set to be a relatively regular rectangle or a similar rectangle, to adapt to an overall shape of the mobile phone as far as possible. In addition, in general, in order to ensure good radiation of the antenna, the antenna will be spaced from the ground module 5 as far as possible. Some plastic stents will generally extend outward from the two short sides of the ground module 5, and the antenna is generally placed on these plastic stents. However, in the present disclosure, in order that those skilled in the art can view the specific positions of the first antenna 1 and the second antenna 2 in the electronic apparatus 3, all the accompanying drawings in the embodiment of the present disclosure will show that the first antenna 1 and the second antenna 2 are close to the ground module 5.

The wavelength of the electromagnetic wave in the low frequency band (e.g., 700-960 MHz) matches a size of the ground module 5, that is, the electrical length of the ground module 5 is relatively close to the resonant electrical length of the antenna when operating in the low frequency band. So, a resonant mode of the antenna is mainly the ground-plate mode radiation in the low frequency band, whereas self-radiation of the antenna takes a smaller proportion of the total radiation. The ground-plate mode radiation can be understood as follows: when the antenna resonates, it radiates an electromagnetic field, which affects the adjacent ground module 5, so that the ground module 5 also resonates to further generate a current, which further involves in electromagnetic field radiation, so as to enhance radiating capability of the entire system. Since both the size and the volume of the ground module 5 are far greater than those of the antenna, most of the radiation in the low frequency band is caused by the ground-plate mode radiation generated by the ground module 5, whereas the self-radiation of the antenna takes a small proportion of the total radiation. Such a mode in which most energy is generated by radiation of the ground module 5 may be referred to as the ground-plate mode radiation.

Since the antenna is disposed on the short sides of the electronic apparatus 3, the antenna can maximally excite the ground module 5 to resonate when resonating, so as to generate the ground-plate mode radiation. That is to say, the antenna disposed on the short sides can excite the ground-plate mode radiation to a maximum extent. In the embodiment of the present disclosure, both the first antenna 1 and the second antenna 2 are disposed on the short sides. In this way, when the first antenna 1 and the second antenna 2 resonate, the ground-plate mode radiation can be better excited, so that that the first antenna 1 transmits and receives data by radiating energy, and the second antenna 2 receives data by radiating energy.

Furthermore, in the embodiment of the present disclosure, the electronic apparatus 3 may further comprise a matching circuit. The matching circuit assists the second antenna 2 to resonate. This is because the actual electrical length of the second antenna 2 is less than its resonant electrical length, such that the second antenna 2 cannot perform self-resonance, and needs the assistance of the matching circuit. In the specific implementation process, the matching circuit may be an element, or may be a circuit composed by a plurality of elements. In order to minimize a volume of the matching circuit in the electronic apparatus 3, when the matching circuit is composed by a plurality of elements, the number of the elements should be minimized. The function of the matching circuit is that, when the second antenna 2 cannot perform self-resonance, the inductance characteristic presented by the matching circuit counterbalances the capacitance characteristic presented by the second antenna 2, or the capacitance characteristic presented by the matching circuit counterbalances the inductance characteristic presented by the second antenna 2, so that the second antenna 2 can resonate to excite the ground-plate mode radiation.

When the battery 6 is closer to the antenna, the electromagnetic field generated by the antenna resonance is not open enough, the energy cannot be effectively radiated, so that the antenna may have a lower efficiency, and cannot cover a broader band. Therefore, the first antenna 1 and the second antenna 2 are disposed on the short sides of the electronic apparatus 3 at the same time, and can be away from the battery 6 as far as possible, which improves efficiencies and bandwidths of the first antenna 1 and the second antenna 2 as far as possible.

Moreover, in order to meet the requirements of aesthetic appearance on the electronic apparatus 3, and process design requirements of an ever larger display screen and an ever narrower long side of the electronic apparatus 3, the first antenna 1 and the second antenna 2 are disposed on an end side of the electronic apparatus 3, which can leave space for the long sides of the electronic apparatus 3 as much as possible to accommodate the display screen, and can maximally meet the process design requirements of the electronic apparatus 3.

Further, the distribution direction of the first current and the distribution direction of the second current present a cross distribution, the correlation between the first antenna 1 and the second antenna 2 is relatively small. At the same time, operation modes of the first antenna 1 and the second antenna 2 can be kept different at most so as to implement different functions. In this way, the overall performance of the antenna system can be improved, and the requirements of the communication system can be met as far as possible.

In the specific implementation process, the first antenna 1 and the second antenna 2 are disposed in the specific positions on the short sides, which includes two Cases below.

Figure 3A:
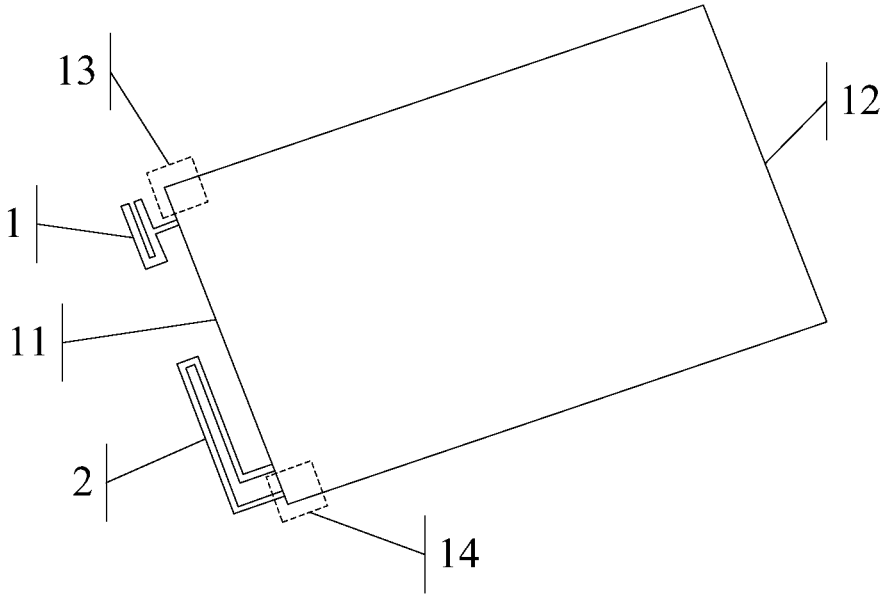
FIG. 3A is a schematic diagram when specific positions of a first antenna and a second antenna are in Case One according to an embodiment of the present disclosure.

Case One:

Optionally, in the embodiment of the present disclosure, with reference to FIG. 3A, the short sides may include a first short side 11 and a second short side 12, the first antenna 1 may be disposed at a first position on the first short side 11, and the second antenna 2 may be disposed at a second position on the first short side 11 which is different from the first position. The first position is close to a first end 13 of the first short side, and the second position is close to a second end 14 of the first short side. That is to say, in the embodiment of the present disclosure, both the first antenna 1 and the second antenna 2 are disposed on the first short side 11 at the same time; and the first position is close to the first end 13 of the first short side 11, and the second position is close to the second end 14 of the first short side 11.

Figure 3B:
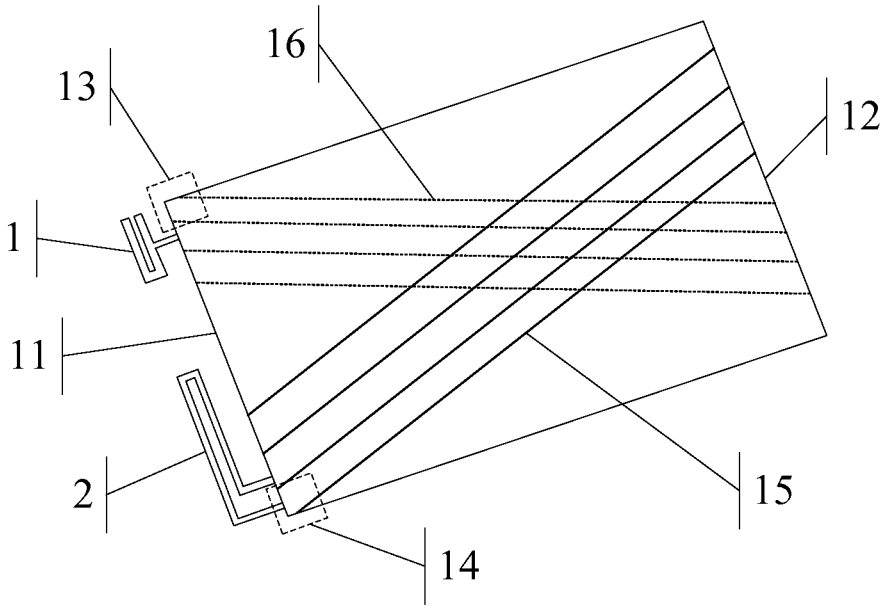
FIG. 3B is a distribution schematic diagram of a first current and a second current, when the specific positions of the first antenna and the second antenna are in Case One according to the embodiment of the present disclosure.

With reference to FIG. 3B, when the first antenna 1 resonates and excites the ground-plate mode radiation, the ground-plate current (i.e., a first current 15) generated will be distributed in a diagonal direction with the first end 13 as a start point; and when the second antenna 2 resonates and excites the ground-plate mode radiation, the ground-plate current (i.e., a second current 16) generated will be distributed in a diagonal direction with the second end 14 as a start point, and the first current 15 and the second current 16 present a cross distribution. Of course, the first current 15 and the second current 16 are actually a total ground-plate current. In the specific implementation process, the first current 15 and the second current 16 should be able to cover the inside of the ground module 5. In order to facilitate those skilled in the art viewing, only a portion decomposed from the ground-plate current is shown in FIG. 3B.

The closer the first antenna 1 and the second antenna 2 are from both ends of the first short side 11 and the smaller the volumes of the two antennas are, the greater a crossing angle between the first current 15 and the second current 16 is, which indicates a lower correlation between the first antenna 1 and the second antenna 2. Therefore, in the specific implementation process, the first antenna 1 may be disposed at a position close to the first end 13 as near as possible, and the second antenna 2 is disposed at a position close to the second end 14 as near as possible, so as to minimize the correlation between the first antenna 1 and the second antenna 2, and to improve the overall performance of the antenna system.

Meanwhile, with the electronic apparatus 5 being a mobile phone as an example, the first short side 11 can be viewed as the lower side of the mobile phone; the first antenna 1 and the second antenna 2 are disposed on the first short side 11 at the same time, which can save space for the second short side 12 as much as possible. Generally, the space corresponding to the second short side 12 will accommodate components such as a distance sensor, a telephone receiver, a front-facing camera, and a breath lamp, which contributes to process design of the electronic apparatus 5.

Figure 4A:
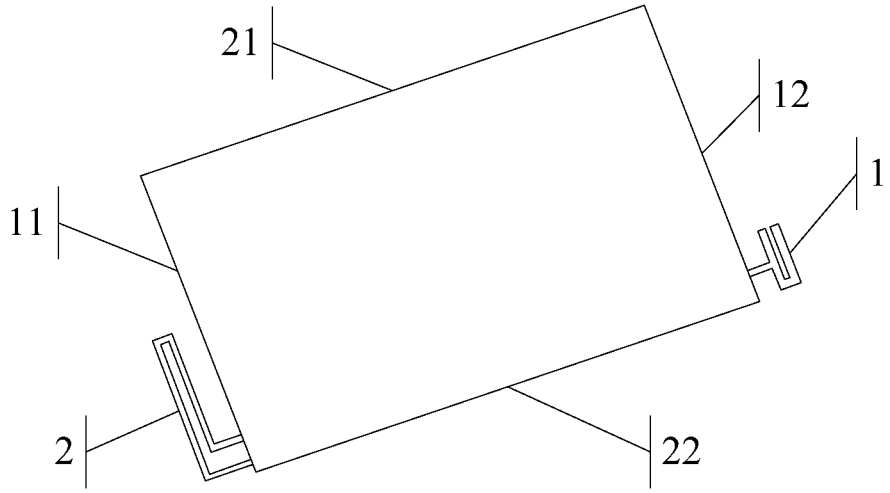
FIG. 4A is a schematic diagram when specific positions of a first antenna and a second antenna are in Case Two according to an embodiment of the present disclosure.

Case Two:

Optionally, in the embodiment of the present disclosure, with reference to FIG. 4A, the short sides may include the first short side 11 and the second short side 12, and the long sides may include a first long side 21 and a second long side 22.

The first antenna 1 may be disposed at a third position on the first short side 11, and the second antenna 2 may be disposed at a fourth position on the second short side 12. The third position and the fourth position are both close to the first long side 21, or both close to the second long side 22.

In the embodiment of the present disclosure, the first antenna 1 and the second antenna 2 are respectively disposed on the first short side 11 and the second short side 12, as shown in FIG. 4A. Since the electrical length of the second antenna 2 is less than the electrical length of the first antenna 1, the second antenna 2 can be disposed on the second short side 12. In addition, the third position and the fourth position are both close to the first long side 21, or are both close to the second long side 22. FIG. 4A shows that both the third position and the fourth position are close the second long side 22, which is an example.

Figure 4B:
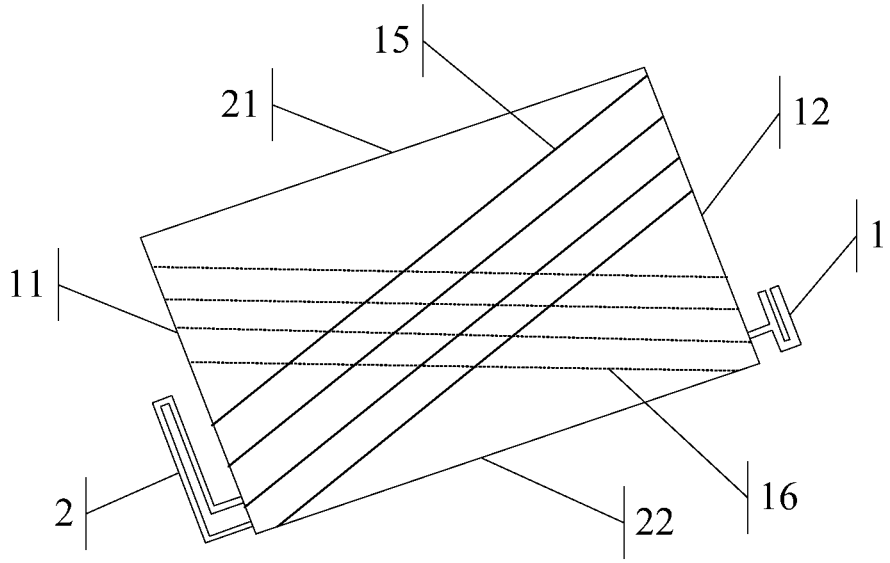
FIG. 4B is a distribution schematic diagram of a first current and a second current, when the specific positions of the first antenna and the second antenna are in Case Two according to the embodiment of the present disclosure.

Based on the same principle as that in Case One, with reference to FIG. 4B, the first antenna 1 resonates and excites the ground-plate mode radiation to generate the first current 15, the second antenna 2 resonates and excites the ground-plate mode radiation to generate the second current 16, and the first current 15 and the second current 16 present a cross distribution. The closer the first antenna 1 and the second antenna 2 are located to the same long side, the greater the crossing angle is, and the lower the correlation between the first antenna 1 and the second antenna 2 is, which can improve the overall performance of the antenna system as much as possible.

In the embodiment of the present disclosure, the length of the first antenna 1 may be less than half of a length of the first short side 11, and the length of the second antenna 2 may be less than half of a length of the second short side 12.

When both the first antenna 1 and the second antenna 2 are close to the same long side at the same time, the smaller the lengths of the first antenna 1 and the second antenna 2 are, the larger the crossing angle between the first current 15 and the second current 16 is, and the lower the correlation between the first antenna 1 and the second antenna 2 is. Therefore, in the embodiment of the present disclosure, the length of the first antenna 1 may be set to be less than half of the length of the first short side 11, and the length of the second antenna 2 may be set to be less than half of the length of the second short side 12. Meanwhile, when the lengths of the first antenna 1 and the second antenna 2 are set, the specific forms of the antennas may be considered comprehensively.

In the technical solution according to the embodiment of the present disclosure, the electrical length of the first antenna 1 is set to be equal to the resonant electrical length, the electrical length of the second antenna 2 is set to be less than the resonant electrical length, and the first antenna 1 and the second antenna 2 are set on the short side of the electronic apparatus 3, some parameters characterizing the performance of the antenna system can have better indicators.

Figure 5:
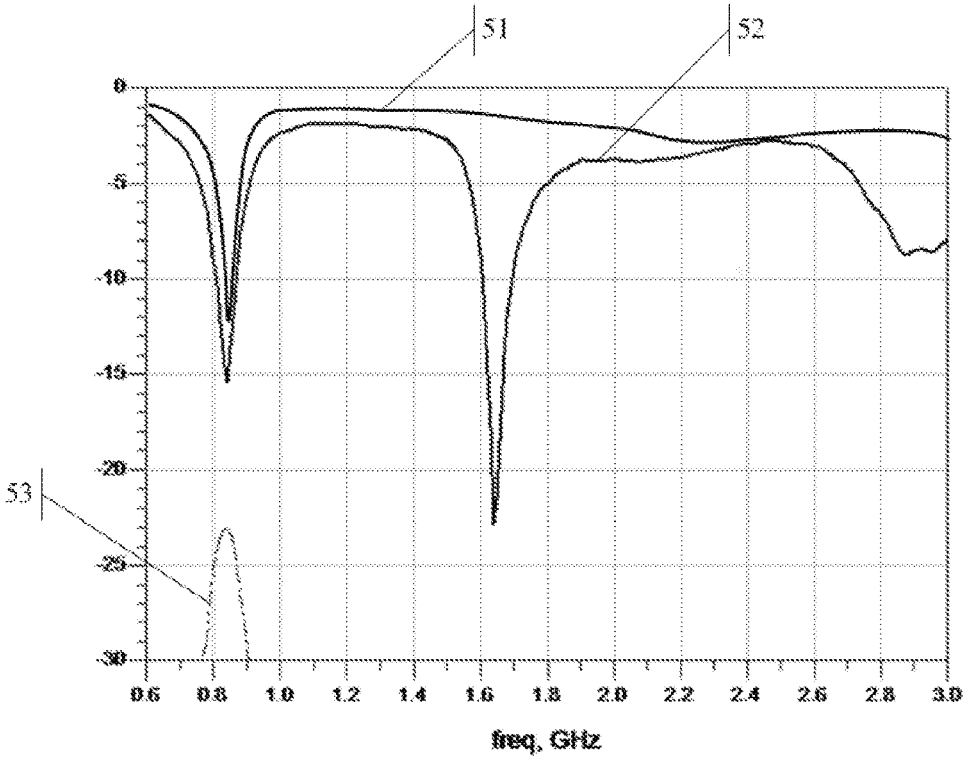
FIG. 5 is a curve chart representing return loss of the first antenna and the second antenna and a curve chart representing isolation between the first antenna and the second antenna according to the embodiment of the present disclosure.

For example, with reference to FIG. 5, an abscissa of FIG. 5 represents the frequency in unit of GHz, and an ordinate either can represent return loss values, or can represent isolation values in unit of dB. In the diagram, a curve 51 is a return loss curve of the first antenna 1, and the return loss values of the first antenna 1 at different frequency points can be seen from the curve 51; a curve 52 is a return loss curve of the second antenna 2, and the return loss values of the second antenna 2 at different frequency points can be seen from the curve 52; a curve 53 is an isolation curve between the first antenna 1 and the second antenna 2, and the isolation values between the first antenna 1 and the second antenna 2 at different frequency points can be seen from the curve 53.

As can be seen from the curve 51, the first antenna 1 has a relatively wide bandwidth in the low frequency band (in the vicinity of about 800 MHz) and in the high frequency band (in the vicinity of about 1.65 GHz), so that it can meet requirements of data transmission and reception in multi-band of 2G, 3G and LTE.

As can be seen from the curve 52, the second antenna 2 has a relatively narrow bandwidth in the low frequency band (in the vicinity of about 800 MHz), and the narrow bandwidth is typically about 40 MHz, so that it can cover the reception frequency band in the LTE low frequency band.

As can be seen from the curve 53, the isolation between the first antenna 1 and the second antenna 2 can be up to 20 dB or more, which indicates the near-field coupling strength between the first antenna 1 and the second antenna 2 is relatively small, and the mutual interference degree between the first antenna 1 and the second antenna 2 is relatively low. Therefore, the respective efficiencies of the first antenna 1 and the second antenna 2 can be improved as far as possible, and the performance of the antenna system is further improved.

Figure 6:
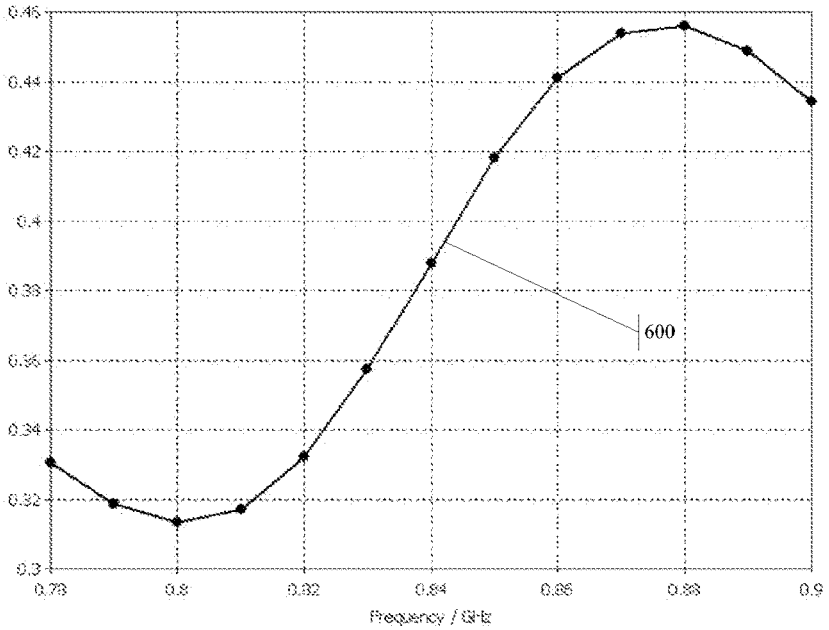
FIG. 6 is a curve chart representing an envelope correlation coefficient between the first antenna and the second antenna according to the embodiment of the present disclosure.

For another example, with reference to FIG. 6, an abscissa in FIG. 6 represents the frequency in unit of GHz, and an ordinate represents envelope correlation coefficient values between the first antenna 1 and the second antenna 2. The envelope correlation coefficient is used for representing the correlation between the first antenna 1 and the second antenna 2, with a value range of [0, 1]. The greater the value is, the greater the correlation between the two antennas is. A curve 600 is an envelope correlation coefficient curve between the first antenna 1 and the second antenna 2. As can be seen from the curve 600, in the bandwidth of the low frequency band covered by the first antenna 1 and the second antenna 2 at the same time, the envelope correlation coefficient value is less than 0.5, which indicates that the correlation between the first antenna 1 and the second antenna 2 is low. Accordingly, the performance of the antenna system can be improved With reference to FIG. 7, based on a same inventive concept, an embodiment of the present disclosure further provides an electronic apparatus 3, and the electronic apparatus 3 may comprise: a housing 4; a main body 5 disposed within the housing 4, for completing tasks that the electronic apparatus 3 needs to perform; and the antenna system according to any one of FIG. 1-FIG. 4B.

Figure 7:
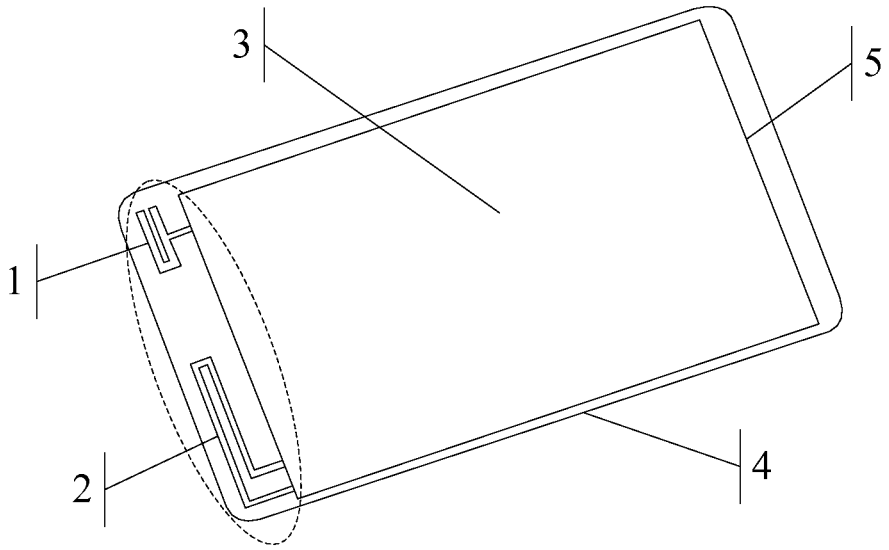
FIG. 7 is a main structural schematic diagram of an electronic apparatus according to an embodiment of the present disclosure.

As can be seen from FIG. 7, the antenna system is constituted by the first antenna 1 and the second antenna 2.

In the embodiment of the present disclosure, the electronic apparatus 3 further comprises the antenna system constituted by the first antenna 1 and the second antenna 2. The first antenna 1 is used for transmitting and receiving data, and an electrical length of the first antenna 1 is equal to a resonant electrical length of the first antenna 1, so that the first antenna 1 can cover a broader bandwidth, and meet requirements of efficiency and bandwidth of the communication system. The second antenna 2 is only responsible for receiving data, covering a narrower bandwidth, and an electrical length of the second antenna 2 is less than a resonant electrical length of the second antenna, so the second antenna 2 has a smaller size and takes a smaller space. On the premise of satisfying data reception, the second antenna 2 can be kept away from the first antenna 1 as far as possible, to minimize a near-field coupling strength between the first antenna 1 and the second antenna 2, reduce mutual interference between the two antennas, and maximize respective efficiencies of the first antenna 1 and the second antenna 2. Accordingly, overall performance of the antenna system can be improved. Furthermore, since the second antenna 2 takes a smaller space, more space within electronic apparatus 3 can be left for the first antenna 1, so that the first antenna 1 can cover a broader band to obtain a better data transmission efficiency, and to further improve the performance of the antenna system.

The first antenna 1 and the second antenna 2 are both disposed on the short side of the electronic apparatus 3, so that the first antenna 1 and the second antenna 2 are able to effectively excite ground-plate mode radiation, which can maximize the data transmission efficiencies of the first antenna 1 and the second antenna 2. Meanwhile, a distribution direction of the current generated from the ground-plate mode radiation excited by resonance of the first antenna 1 and a distribution direction of the current generated from the ground-plate mode radiation excited by resonance of the second antenna 2 present a cross distribution. The correlation between the first antenna 1 and the second antenna 2 can be minimized, so as to further improve the overall performance of the antenna system, and to maximally meet the requirements of the communication system.

Meanwhile, since the first antenna 1 and the second antenna 2 are both disposed on the short side, more space can be left as much as possible for the long side of the electronic apparatus 3 to accommodate a display screen, so as to meet aesthetic requirements on electronic apparatus 3, and process design requirements of an ever larger display screen and an ever narrower frame. Moreover, the antenna system can also be kept away from a battery of the electronic apparatus 3 as far as possible, to minimize impact of the battery on the first antenna 1 and the second antenna 2 during energy radiation. Accordingly, operation efficiencies and bandwidths of the first antenna 1 and the second antenna 2 can be improved.

It is evident that one person skilled in the art can make various changes or modifications to the present disclosure without departing from the spirit and scope of the present disclosure. Thus, if these changes and modifications to the present disclosure are within the scope of the claims of the present disclosure and equivalent technologies, the present disclosure also intends to include all such changes and modifications within its scope.

The invention claimed is:

1. An antenna and electronic apparatus system comprising:

an antenna system comprising:

a first antenna for transmitting and receiving data, the first antenna having an electrical length;

a second antenna for receiving data without transmitting data, the second antenna having an electrical length less than the electrical length of the first antenna; and a matching circuit to assist the second antenna to resonate, wherein the first antenna, the second antenna, and the matching circuit are disposed in an electronic apparatus that comprises:

a short side comprising a first short side and a second short side; and a long side comprising a first long side and a second long side, with the short side having a length less than a length of the long side, and wherein the first antenna and the second antenna are disposed on the short side, and wherein the first antenna resonates and excites to generate a first current, the second antenna resonates and excites to generate a second current, and a distribution direction of the first current and a distribution direction of the second current present a cross distribution, the first antenna being disposed at a first position on the first short side, and the second antenna being disposed at a second position on the second short side; wherein, the first position and the second position are both close to the first long side, or both close to the second long side, and wherein a physical length of the first antenna is less than half of a length of the first short side and a physical length of the second antenna is less than half of a length of the second short side.

2. The antenna and electronic apparatus system according to claim 1, wherein the first antenna and the second antenna receive data in a same frequency band.

3. The antenna and electronic apparatus system according to claim 2, wherein a volume of the second antenna is less than a volume of the first antenna.

4. The antenna and electronic apparatus system according to claim 1, wherein the electronic apparatus further comprises a ground module; when the first antenna resonates, the first antenna is used for exciting the ground module to resonate to generate the first current.

5. The antenna and electronic apparatus system according to claim 4, wherein when the second antenna resonates, the second antenna is used for exciting the ground module to resonate to generate the second current.

* * * * *